US006755986B2

(12) United States Patent
Anding et al.

(10) Patent No.: US 6,755,986 B2
(45) Date of Patent: Jun. 29, 2004

(54) MOVING TURBINE BLADE

(75) Inventors: Dirk Anding, Karlsfeld (DE); Michael Strassberger, München (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 13 days.

(21) Appl. No.: 10/204,693

(22) PCT Filed: Feb. 1, 2001

(86) PCT No.: PCT/EP01/01063

§ 371 (c)(1),
(2), (4) Date: Aug. 23, 2002

(87) PCT Pub. No.: WO01/63098

PCT Pub. Date: Aug. 30, 2001

(65) Prior Publication Data

US 2003/0021686 A1 Jan. 30, 2003

(30) Foreign Application Priority Data

Feb. 25, 2000 (EP) ..... 00104002

(51) Int. Cl.[7] ..... F01D 5/18
(52) U.S. Cl. ..... 216/244 A

(58) Field of Search ..... 416/193 R, 219 R, 416/244 A, 245, 193 A

(56) References Cited

U.S. PATENT DOCUMENTS

| | | | |
|---|---|---|---|
| 3,695,778 A | 10/1972 | Taylor | 416/92 |
| 4,595,340 A | 6/1986 | Klassen et al. | 416/193 A |
| 5,407,326 A | 4/1995 | Lardellier | 416/233 |

FOREIGN PATENT DOCUMENTS

| | | |
|---|---|---|
| EP | 0924381 | 6/1999 |

*Primary Examiner*—Edward K. Look
*Assistant Examiner*—Dwayne J. White
(74) *Attorney, Agent, or Firm*—Harness, Dickey & Pierce, P.L.C.

(57) ABSTRACT

A moving turbine blade includes a blade profile with inner cooling which extends out from a blade platform adjoined by a blade foot, the blade foot engaging with a turbine disk and having a radial cross-section with an area whose width increases towards the blade platform. A moving turbine blade of this type is configured in such a way as to enable the moving blade profile to be lengthened. To this end, the blade foot has a hollowed-out section which opens out in the direction facing away from the platform side and which has a widened cross section in the area of the blade foot whose width increases.

24 Claims, 3 Drawing Sheets

MOVING TURBINE BLADE

This application is the national phase under 35 U.S.C. §371 of PCT International Application No. PCT/EP01/01063 which has an International filing date of Feb. 1, 2001, which designated the United States of America and which claims priority on European Patent Application No. 001 04 002.1 filed Feb. 25, 2000, the entire contents of which are hereby incorporated herein by reference.

FIELD OF THE INVENTION

The invention generally relates to a turbine rotor blade. Preferably, it relates to one having an internally uncooled blade profile, which extends starting from the blade platform on which a blade root abuts. The blade root preferably engages in a turbine disk and has a radial cross section with a region of increasing width toward the blade platform.

BACKGROUND OF THE INVENTION

In order to increase the efficiency and/or the effective cross section of gas turbines, the blade profiles of the turbine rotor blades are lengthened as much as possible in order, by this, to achieve a better utilization of the hot gases flowing past. This lengthening of the blade profile is, however, limited by a plurality of parameters.

Due to the lengthened blade profile and the increased mass moved because of it, a hub region of the turbine disk, for example, is severely loaded by the centrifugal force applied to it. An attempt is made to counter this by increasing the load-supporting area in the hub region by axially lengthening the disk. This lengthening possibility is, however, limited.

Due to the increased blade profile, it is not only the hub which is more severely loaded but also the region in which the turbine blades are inserted, via their roots, into retention recesses of the outer periphery of the turbine disk. A lengthening of the blade profile can also take place radially relative, to the disk hub. But, due to this, the retention recesses of the outer periphery would be brought closer together. Further, their distance apart would become smaller and, therefore, the disk region between them would be more severely loaded. This loading, however, can only be increased to a limited extent without risking damage to the turbine disk.

SUMMARY OF THE INVENTION

An object of an embodiment of the present invention is to create a turbine rotor blade which permits a lengthening of the rotor blade profile without an increase, or with only a slight increase, in local loadings on the turbine disk and/or rotor blade roots.

An object may be achieved by an embodiment of the present invention by a blade root having an open cavity, which faces away from the platform, having a blind ending at the platform end and having a cross section which widens in the region of increasing width of the blade root.

In order to secure strength, the blade root usually has a solid configuration and, in comparison to the other dimensions of the turbine blade, has a larger cross section. In consequence, its mass is high and represents a large proportion of the centrifugal force loading, which occurs during rotation of the turbine blades, on the turbine disk and on the retention fixtures for the blades. The cavity considerably decreases the mass of the root and therefore the centrifugal force load. The particular shape of the cavity, namely a widening of the cross section at the longitudinal walls in the region of increasing width of the blade root, ensures an optimum utilization of the shape of the blade root with respect to reducing the mass. Because the cavity has a blind ending at the platform end, the strength requirements—which are very high particularly in the region between platform and blade profile due to numerous severe force and temperature effects—are satisfied.

At the same time, therefore, an embodiment of the invention permits the mass of the blade to be kept small and its strength to be maintained or even improved. Due to the reduction in weight, the average stress level in the root region is lowered and stress peaks in the retention teeth of the root and the adjacent turbine disk are moderated, which leads to a lengthening of the life of the turbine blades and, in particular, to an improvement in the durability of the root. Without endangering the strength of the turbine blade and while retaining the shape of the root, it is therefore possible to lengthen the rotor blade profile outward and, by this means, to increase the efficiency of the turbine.

A satisfactory strength of the platform-end blade profile region is provided because the cavity ends in a transition region between the blade root and below the upper surface of the platform. The force effect on the blade is particularly high above the platform upper surface and the blade has a narrower configuration than it has in the platform region. If, however, the cavity ends below the upper surface of the platform, the force effect is, to a sufficient extent, accepted by the stable platform and the adjacent regions.

In order to avoid stress peaks and, therefore, locally excessively high loads, it is proposed that the cavity should be bounded by mainly rounded walls and should end in a vaulted shape below the platform upper surface.

A very large reduction in mass is provided by the fact that longitudinal walls of the cavity extend over practically the complete length of the blade root and transverse walls extend over almost the complete width of the blade root, the walls of the cavity ensuring sufficient strength when centrifugal force is applied.

The forces, the major part of which are applied centrally, are transmitted well in solid regions of the blade without loading the walls of the cavity too severely, if the cavity has its maximum height in the central region and falls away toward the transverse walls and longitudinal walls.

If regions of the longitudinal walls of the cavity widen continually on approaching the platform end while maintaining a minimum wall thickness at the transverse walls of the cavity, the weight reduction is improved and, at the same time, an abrupt change in the curvature, which leads to local stress maxima, is avoided on transition to a rounded end region.

The hot working gases particularly affect those edge regions of the blade which are the first to be directly subjected to the incident flow. Account is taken of the higher strength requirements of the hot gas incident flow end by the minimum wall thickness being greater in the vicinity of the hot gas incident flow end than it is at the hot gas outlet flow end.

An increase in the strength of the root, while economizing in material and mass, is provided by the blade root being reinforced by transverse struts configured between its longitudinal walls. The forces applied to a longitudinal wall of the cavity are transferred through the transverse struts to the other longitudinal wall of the cavity and through both walls to the turbine disk, without endangering the strength of the cavity. Due to the further reduction in the mass, furthermore, there is a further removal of load from the root because of the reduced centrifugal force load.

If the transverse struts are at a distance from the walls of the cavity at the platform end of the blade root and/or from the end facing away from the platform of the blade root, this provides an additional economy in weight while retaining the strength.

Optimum transmission of the forces takes place because positions and shapes of the transverse struts are matched to a force line path which occurs due to the application of centrifugal forces to the blade profile. By a matched number and shape of the transverse struts, it is therefore possible, on the one hand, greatly to reduce the mass of the blade root (because the walls of the cavity can have a thinner configuration due to the supporting effect of the transverse struts) and, at the same time, it is possible to maintain a homogeneous stress variation along the longitudinal sides of the cavity because of the support by the transverse struts.

The particularly high forces applied in the central region are accepted because the transverse struts of the cavity have their maximum height in the central region and decrease in height to match a fall-away in the shape of the cavity.

BRIEF DESCRIPTION OF THE DRAWINGS

An exemplary embodiment of the invention is provided in the figures. In these.

DETAILED DESCRIPTION OF THE PREFERRED EMBODIMENTS

Figure 1:
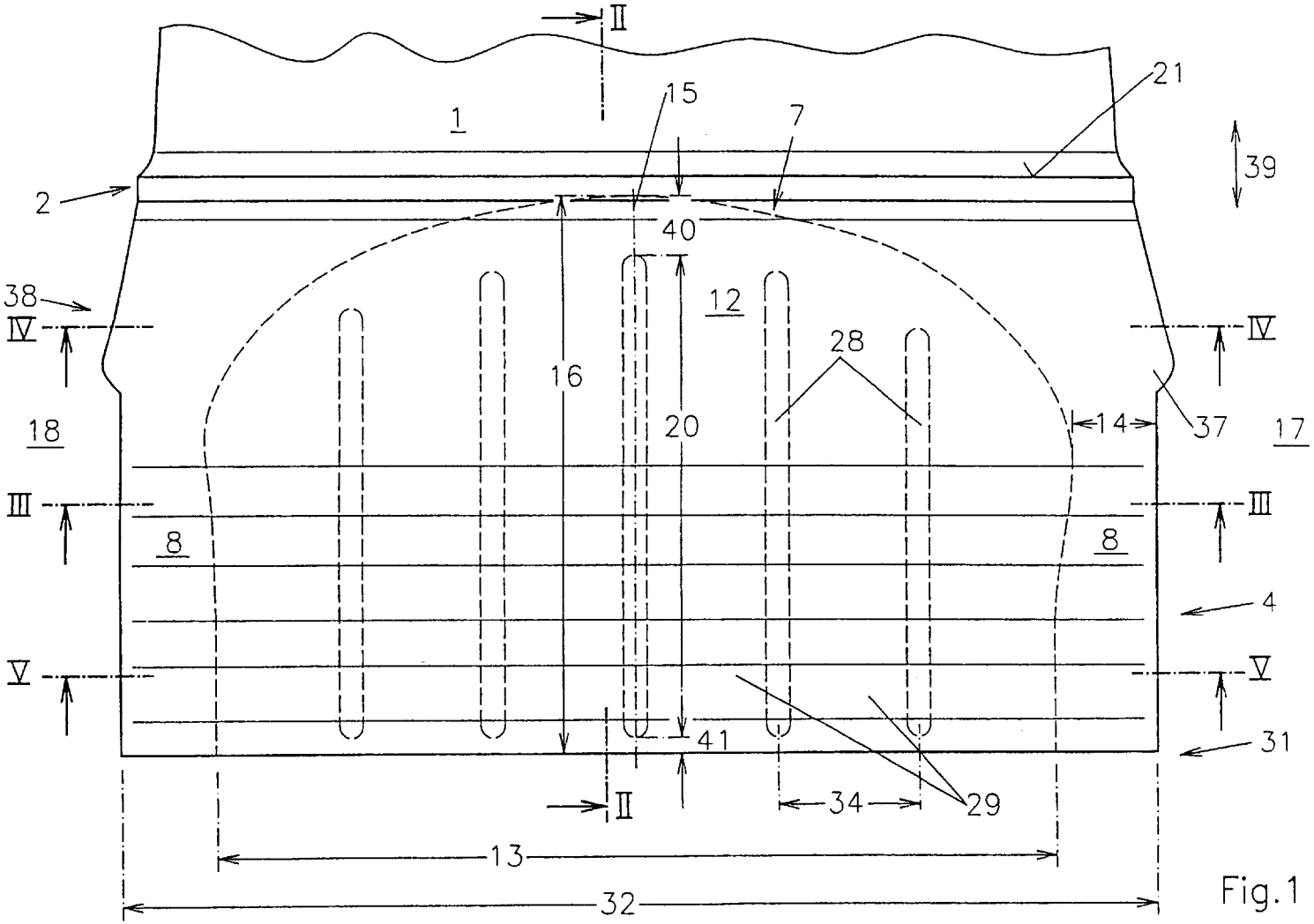
FIG. 1 shows a radial cross section through a root region of a turbine blade.
Figure 2:
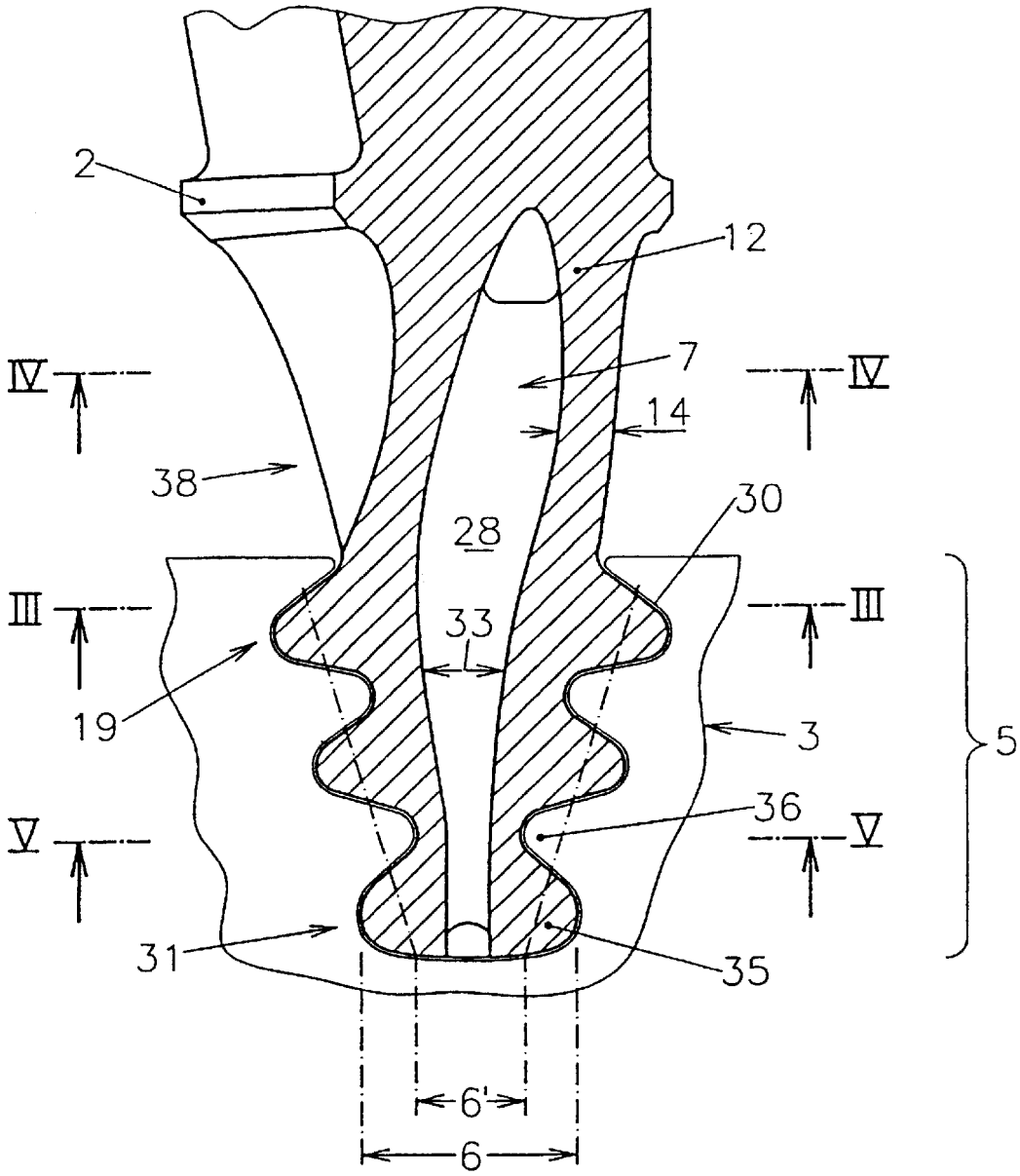
FIG. 2 shows a longitudinal section through a root region of a turbine blade, as shown in FIG. 1, along the section line II—II.

FIG. 1 shows a radial cross section through a root 4, a platform 2 and a part of the blade profile 1 of a turbine blade. The root 4 is pushed into a retention recess 30 of the turbine disk 3 and is positively held by teeth 35 of the root 4 and corresponding teeth 36 of the retention recess 30, as is represented in FIG. 2. Root 4, platform 2 and profile 1 are formed, preferably cast, integrally and coherently. Adjacently arranged blade profiles 1 offer resistance to hot gas which is flowing past and alter its velocity and direction, by which the turbine disk 3 is excited to rotations about a disk center line, with very high rotational speed. The centrifugal forces then occurring must be essentially accepted by the teeth 35 of the blade root 4 and the teeth 36 of the retention recess 30. Particularly in the case of internally uncooled turbine blades, large parts of the turbine blade generally have a solid configuration and therefore possess a high weight, which severely loads the root regions.

According to an embodiment of the invention, the root 4 has a weight-reducing cavity 7. This is of vaulted shape and has a blind ending at the platform end 19 of the turbine blade below the upper surface 21 of the platform 2. The cavity 7 is open at an end 31, facing away from the platform, of the root 4. In the region of the end 31 facing away from the platform, the root 4 has a substantially constant length 32. The length 32 increases somewhat on approach to the platform 2, initially because of a protrusion 37 formed on the transition region 38 and subsequently decreases continuously to the platform 2. The cavity 7 possesses lengths 13, of the longitudinal walls 12, and depths 33.

Starting from the end 31 facing away from the platform, the lengths 13 increase after a certain distance as far as the platform end 19 of the root 4 and become shorter in curved shape in the transition region 38 as far as the highest point with the height 16 of the cavity 7, where the cavity 7 has a blind ending. This end is preferably located in the region of or below the platform upper surface 21 in order to ensure sufficient blade strength. In the platform region, the blade profile is solid and possibly has a weight-saving blade profile cavity in the (not shown) upper region of the blade profile at a distance from the platform. This avoids endangering the sturdiness of the blade in the platform region. The cavity 7 has no connection to the blade profile cavity because an internally uncooled turbine blade is involved and, in consequence, no transport of coolant is necessary through the root.

As shown in FIG. 2, the depth 33 increases (in a region 5) from the end 31, facing away from the platform, of the root 4 to the platform end 19. The cavity 7 then follows a curvature of the turbine blade in the transition region 38. In the transition region 38, the depth 33 initially increases somewhat and then decreases continuously, approximately from the center of the transition region 38 to the platform 2. By this, a maximum possible region is hollowed out within the root 4 and within the transition region 38 in order to achieve a maximum reduction of weight. Attention must then be paid, in particular, to the walls 8, 12 having sufficient wall thicknesses 14 to ensure the strength of the root 4 even in the case of a strong application of centrifugal forces. Stress peaks, which lead to a reduction in the strength, are avoided by the curved configuration of the cavity 7.

The manufacture of the cavity 7 can take place by use of a cast core with break-mould, which is inserted in the root region of the blade before the casting operation and protrudes beyond the end 31, facing away from the platform, of the root 4, so that an open cavity is formed facing away from the platform. At the platform end 19 of the root 4, the casting core is configured as a blind core which ends there. After the casting process, the core is destroyed and removed from the cavity 7 because the width becomes smaller toward the opening and the core cannot be removed as a complete unit.

Transverse struts 28, which extend between the longitudinal walls 12, are applied within the cavity 7. The cavity 7 is supported against applied forces, which act on the walls 8, 12, by the transverse struts 28. In the exemplary embodiment, there are five transverse struts 28, of which the transverse strut 28 in the central region 15 of the cavity 7 has the maximum height 20 and is arranged in the region of the maximum height 16 of the cavity 7. The transverse struts 28 are rounded in order to avoid stress peaks. They are arranged substantially parallel to one another at distances apart 34 in the direction of a longitudinal axis 39 of the turbine blade. They occupy almost the complete region between the two opposite longitudinal walls 12. It is only at the platform end of the cavity 7 and the end facing away from the platform of the cavity 7 that there are rounded regions, free of transverse struts, with a distance 40 to the upper boundary of the cavity 7 and a distance 41 to the lower end 31, facing away from the platform. The regions free from transverse struts are substantially determined by manufacture because fingers of a cast core, by which the material-free regions between the transverse struts 28 are produced, are connected together at ends in order to permit the retention of correct dimensions. In addition, they also contribute to a further economy in weight.

FIG. 2 shows a radial cross section, along the section line II—II, at an angle almost at right angles to the first longitudinal section of FIG. 1. The root 4 has curved teeth 35 at regular distances apart and these engage behind correspondingly shaped teeth 36, of the retention recess 30 of the turbine disk 3, in which the root 4 is inserted. They therefore ensure a secure positive connection to prevent the turbine blades from slipping out when centrifugal force loading is applied. From the end 31 facing away from the platform to the platform end 19 of the root 4, an average width 6' of the root 4 increases. This average width 6' is formed by the teeth 35 and intermediate inward curves and follows the depth 33 of the transverse range of the cavity 7, while maintaining strength-securing minimum wall thicknesses of the walls 12. The transition region 38 abutting the root 4 has lens-type curvature, as is clear in the cross section of FIG. 4. Relative to its configuration in FIG. 4, the cavity 7 is correspondingly displaced in such a way that sufficient wall thicknesses 14 are guaranteed on both sides of the cavity 7.

Figures 3, 4, 5:
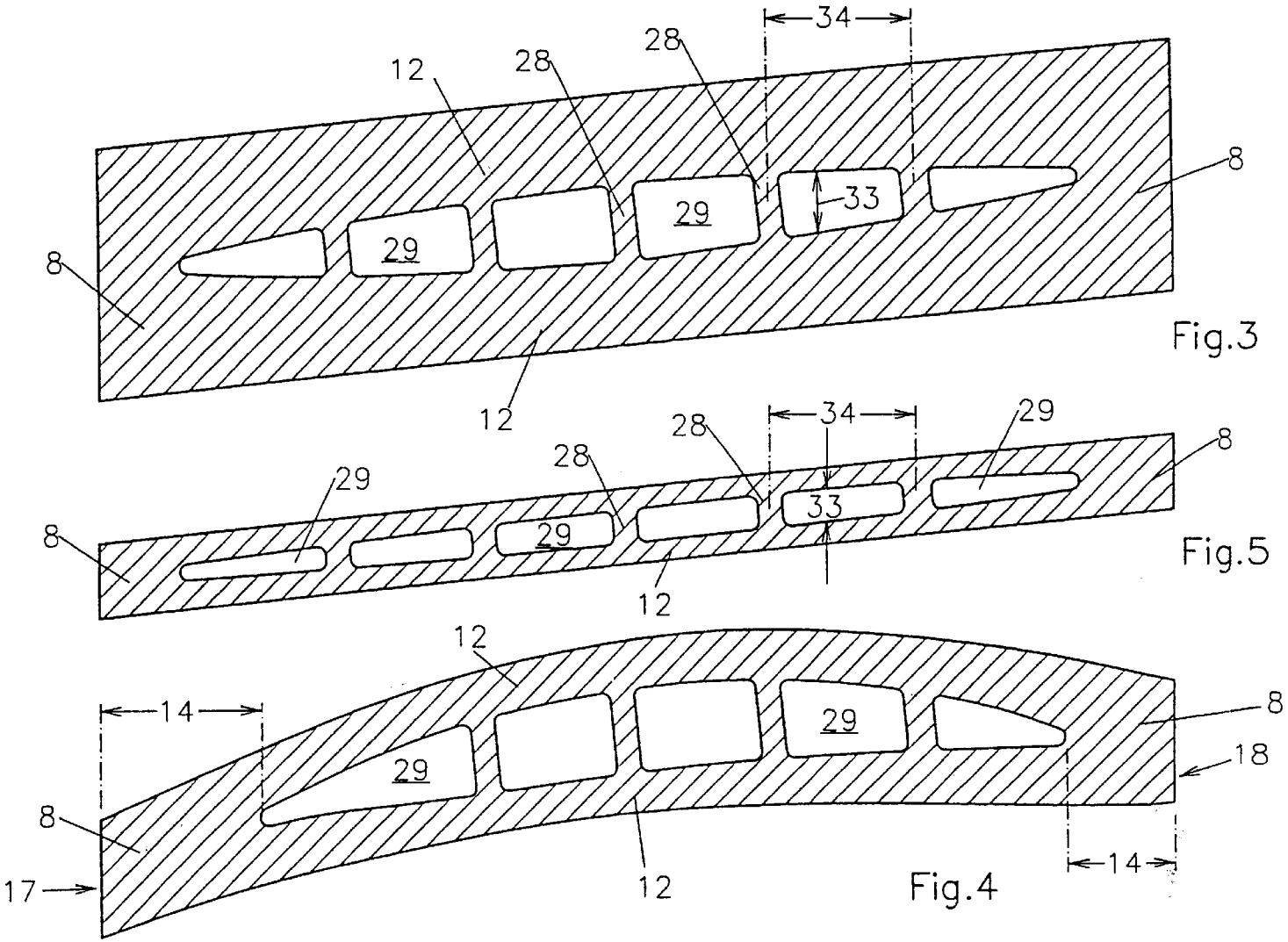
FIG. 3 shows a cross section through a root region of a turbine blade, as shown in FIG. 1, along the section line III—III.
FIG. 4 shows a cross section through a root region of a turbine blade, as shown in FIG. 1, along the section line IV—IV.
FIG. 5 shows a cross section through a root region of a turbine blade, as shown in FIG. 1, along the section line V—V.

FIG. 3 shows a cross section through the root 4 along the section line III—III from FIG. 1 and/or FIG. 2. The width 6 of the cross section through the root is quite large because the section runs through an upper tooth 35 of the root 4, i.e. in the region of the maximum width 6 of the root 4. In this section, the cavity 7 includes of several chambers 29, the transverse struts 28 corresponding to separating walls of the chambers 29. Starting from the two transverse walls 8 of the root 4, the chambers 29 initially have an increasing depth 33, which has its maximum extent at the central transverse strut 28. It then decreases again on approach to the other transverse wall 8 of the root 4. In order to avoid stress peaks, the boundaries of the chambers 9 have a rounded configuration on all sides.

FIG. 4 shows a section through the transition region 38, along the section line IV—IV of FIG. 1 and/or FIG. 2. In this region, the cavity 7 has only five chambers 29 and four transverse struts 28 because the section is taken above the transverse strut nearest to the side with hot gas incident flow. There is, therefore, an increased chamber 29 to be seen in the region of the hot gas incident flow end 17. In the region of the hot gas incident flow end 17, the wall thickness 14 of the wall 8 is greater than it is in the opposite, hot gas outlet flow end 18 region. By this matched, slightly asymmetrical configuration of the cavity 7, the individually reinforced stresses or applied forces can be accepted, with optimum economy in weight, while maintaining sturdiness.

FIG. 5 shows, in contrast, a section through the narrowest region of the root 4—along the section line V—V of FIG. 1 and/or, correspondingly, FIG. 2. The chambers 29 of the cavity 7 have, likewise, a cross-sectional depth 33 which increases starting from the transverse wall 8; the change in cross section is not, however, as large as it is in the case of FIG. 3. The maximum is again located in the region of the central transverse strut 28.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A turbine rotor blade, comprising:

an internally uncooled blade profile, extending starting from a blade platform on which a blade root abuts, wherein the blade root engages in a turbine disk and includes a radial cross section with a region of increasing width toward the blade platform and an open cavity facing away from the platform, the open cavity having a blind ending at the platform end and a cross section widening in the region of increasing width of the blade root, wherein longitudinal walls of the cavity extend alone the length of the blade root and transverse walls of the cavity extend along the width of the blade root, such that an opening of the cavity is located at an end of the blade root and faces toward a rotation axis of the turbine rotor blade.

2. A gas turbine including the turbine rotor blade of claim 1.

3. The turbine rotor blade as claimed in claim 1, wherein the longitudinal walls of the cavity extend over practically the complete length of the blade root and the transverse walls of the cavity extend over almost the complete width of the blade root, the walls of the cavity ensuring sufficient strength when centrifugal force is applied.

4. The turbine rotor blade as claimed in claim 1, wherein the cavity is bounded by mainly rounded walls and ends in vaulted shape below the platform upper surface.

5. The turbine rotor blade as claimed in claim 4, wherein the longitudinal walls of the cavity extend over practically the complete length of the blade root and the transverse walls of the cavity extend over almost the complete width of the blade root, the walls of the cavity ensuring sufficient strength when centrifugal force is applied.

6. The turbine rotor blade as claimed in claim 1, wherein the cavity ends in a transition region between the blade root and below the upper surface of the platform.

7. The turbine rotor blade as claimed in claim 6, wherein the cavity is bounded by mainly rounded walls and ends in vaulted shape below the platform upper surface.

8. The turbine rotor blade as claimed in claim 6, wherein the longitudinal walls of the cavity extend over practically the complete length of the blade root and the transverse walls of the cavity extend over almost the complete width of the blade root, the walls of the cavity ensuring sufficient strength when centrifugal force is applied.

9. A gas turbine, including the turbine rotor blade of claim 6.

10. The turbine rotor blade as claimed in claim 6, wherein the blade root is reinforced by transverse struts configured between the longitudinal walls of the cavity.

11. The turbine rotor blade as claimed in claim 10, wherein the transverse struts are at a distance from at least one of the walls of the cavity at the platform end of the blade root and from the end facing away from the platform of the blade root.

12. The turbine rotor blade as claimed in claim 6, wherein regions of the longitudinal walls of the cavity widen continually on approaching the platform end, while maintaining a minimum wall thickness at the transverse walls of the cavity.

13. The turbine rotor blade as claimed in claim 12, wherein the minimum wall thickness is greater in the vicinity of a hot gas incident flow end than it is at a hot gas outlet flow end.

14. A turbine rotor blade, comprising:

an internally uncooled blade profile, extending starting from a blade platform on which a blade root abuts, wherein the blade root engages in a turbine disk and includes a radial cross section with a region of increasing width toward the blade platform and an open cavity facing away from the platform, the open cavity having a blind ending at the platform end and a cross section widening in the region of increasing width of the blade root, wherein the cavity includes its maximum height in the central region and falls away toward transverse walls and longitudinal walls.

15. The turbine rotor blade as claimed in claim 14, wherein longitudinal walls of the cavity extend over practically the complete length of the blade root and transverse walls of the cavity extend over almost the complete width of the blade root, the walls of the cavity ensuring sufficient strength when centrifugal force is applied.

16. The turbine rotor blade as claimed in claim 14, wherein the blade root is reinforced by transverse struts configured between longitudinal walls of the cavity.

17. A turbine rotor blade, comprising:

an internally uncooled blade profile, extending starting from a blade platform on which a blade root abuts, wherein the blade root engages in a turbine disk and includes a radial cross section with a region of increasing width toward the blade platform and an open cavity facing away from the platform, the open cavity having a blind ending at the platform end and a cross section widening in the region of increasing width of the blade root, wherein regions of longitudinal walls of the cavity widen continually on approaching the platform end, while maintaining a minimum wall thickness at transverse walls of the cavity.

18. The turbine rotor blade as claimed in claim 17, wherein the minimum wall thickness is greater in the vicinity of a hot gas incident flow end than it is at a hot gas outlet flow end.

19. A turbine rotor blade, comprising:

an internally uncooled blade profile, extending starting from a blade platform on which a blade root abuts, wherein the blade root engages in a turbine disk and includes a radial cross section with a region of increasing width toward the blade platform and an open cavity facing away from the platform, the open cavity having a blind ending at the platform end and a cross section widening in the region of increasing width of the blade root, wherein the blade root is reinforced by transverse struts configured between longitudinal walls of the cavity.

20. The turbine rotor blade as claimed in claim 19, wherein the transverse struts are at a distance from at least one of the walls of the cavity at the platform end of the blade root and from the end facing away from the platform of the blade root.

21. The turbine rotor blade as claimed in claim 20, wherein positions and shapes of the transverse struts are matched to a force line path which occurs due to the application of centrifugal forces to the blade profile.

22. The turbine rotor blade as claimed in claim 21, wherein the transverse struts of the cavity have their maximum height in the central region and decrease in height to match a fall-away in the shape of the cavity.

23. A turbine rotor blade, comprising:

a blade profile extending from a blade platform on which a blade root abuts, wherein the blade root includes a radial cross section with a region of relatively increasing width toward the blade platform and an open cavity facing away from the platform, the cavity having a dead end at the platform end and a cross section relatively widening in the region of increasing width of the blade root, and wherein an opening of the cavity faces toward a rotation axis of the turbine rotor blade.

24. A gas turbine including the turbine rotor blade of claim 23.

* * * * *